US005383008A

United States Patent [19]

Sheridon

[11] Patent Number: 5,383,008

[45] Date of Patent: Jan. 17, 1995

[54] LIQUID INK ELECTROSTATIC IMAGE DEVELOPMENT SYSTEM

[75] Inventor: Nicholas K. Sheridon, Los Altos, Calif.

[73] Assignee: Xerox Corporation, Stamford, Conn.

[21] Appl. No.: 174,916

[22] Filed: Dec. 29, 1993

[51] Int. Cl.[6] ..... G03G 15/10; G03G 15/14

[52] U.S. Cl. ..... 355/256; 430/117; 430/126; 355/271

[58] Field of Search ..... 355/256, 271–274; 430/126, 117, 67

[56] References Cited

U.S. PATENT DOCUMENTS

| | | | |
|---|---|---|---|
| 3,284,406 | 11/1966 | Nelson . | |
| 3,847,642 | 11/1974 | Rhodes | 430/126 |
| 3,850,829 | 11/1974 | Smith et al. . | |
| 4,306,009 | 12/1981 | Veillette et al. . | |
| 4,538,163 | 8/1985 | Sheridon . | |
| 4,812,860 | 3/1989 | Sheridan et al. . | |
| 5,176,974 | 1/1993 | Till et al. . | |

OTHER PUBLICATIONS

Larson et al., "Effect of Aminoalcohol Partitioning on Liquid Electrostatic Toner Particle Charging and Mobility", Journal of Imaging Technology, vol. 17, No. 5, Oct./Nov. 1991, pp. 210–214.

Schneider et al., "Electrohydrodynamic Stability of Space–Charge–Limited Currents in Dielectric Liquids. I. Theoretical Study" The Physics of Fluids, vol. 13, No. 8, Aug. 1970, pp. 1948–1954.

Schmidt et al., "Liquid Toner Technology", Handbook of Imaging Materials, Marcel Dekker, Inc., Edited by Arthur S. Diamond, Diamond Research Corp. Ventura, Calif. pp. 227–252.

Stephen et al., "Physics of Liquid Crystals", Reviews of Modern Physics, vol. 46, No. 4, Oct. 1974, pp. 617–690.

*Primary Examiner*—R. L. Moses

*Attorney, Agent, or Firm*—Oliff & Berridge

[57] ABSTRACT

A method and apparatus form a toned image on a copy sheet using a transfer layer. An imaging member is charged and a latent electrostatic image is formed on it. Subsequently, a highly viscous or non-Newtonian liquid transfer layer is applied over the latent electrostatic image. The latent electrostatic image is then developed to form a toned image, which is subsequently transferred to the copy sheet.

28 Claims, 2 Drawing Sheets

LIQUID INK ELECTROSTATIC IMAGE DEVELOPMENT SYSTEM

BACKGROUND OF THE INVENTION

1. Field of the Invention

This invention relates generally to a system for electrostatically printing an image and more particularly concerns a method of liquid ink development.

2. Description of Related Art

Many electrostatic developing systems use dry particle toners to create toned images on imaging drums. However, dry particle toners have numerous disadvantages. Because small dry toner particles become readily airborne, causing health hazards and machine maintainability problems, their diameters are seldom less than 3 microns, which limits the resolution obtainable with dry toner particles. Further, thick layers of dry toner, such as is necessary in color images, causes significant paper curl and thereby limits duplex applications. Therefore, there has been a great desire to develop liquid development systems.

Liquid ink development systems are generally capable of very high image resolution because the toner particles can safely be ten or more times smaller than dry toner particles. Liquid ink development systems show impressive grey scale image density response to variations in image charge and achieve high levels of image density using small amounts of liquid developer. Additionally, the systems are usually inexpensive to manufacture and are very reliable. However, liquid ink development systems are based on volatile liquid carriers and, as a result, they pollute the environment. Consumers are often wary about using such liquid development systems for fear of health hazards. Therefore, there is a strong desire for a liquid ink development system that does not create airborne pollution.

Prior art liquid ink development systems operate such that the photoconductor surface rotates through the developer bath to make contact with the toner. In these systems, the toner particles are attracted to the latent electrostatic image on the photoconductor surface. The motion of the toner particles in the imagewise electric field is generally called electrophophoresis and is well known in the art. However, the liquid carrier also wets the photoconductor surface. It is very difficult to transfer the toner image to paper without either first removing the liquid carrier from the photoconductor surface or using the liquid carrier to enable transfer to the paper and subsequently removing the liquid carrier from the paper, In both cases, the liquid carrier must be removed by processes that must include evaporation of the liquid carrier into the air, which causes airborne pollution.

U.S. Pat. No. 4,306,009 to Veillette et al. discloses a vinyl polymeric gel (called a "gelatex") used in a developer as a fixative and as a dispersant. The gelatex component is present in the carrier as a stable dispersion and is substantially depleted as multiple copies are produced. The disclosed gelatex is not in any sense used as a transfer layer as described below.

SUMMARY OF THE INVENTION

This invention discloses a method of liquid ink development of electrostatic images that avoids the problem of airborne pollution from volatile liquid carriers that is a major drawback in prior liquid development systems. In addition, the ink that is applied to the paper has chemical and physical properties typical of printing inks and therefore enjoys the benefits and understanding of this very well understood technology. A high quality, non-smear image is produced on the paper with a very low background and essentially no solvent carryout. This invention uses a developer comprising a high concentration of submicron pigment particles dispersed in a viscous liquid. The submicron pigment particles move through a viscous liquid, and through a protective transfer layer whose characteristics may be like those of a gel.

Nearly any standard printing ink chemistry can be practiced with this technology. Thus drying agents and pigments and vehicles common to such usage can be effectively employed. For example, heat setting or ultraviolet light curing vehicles such as cellulose acetate propionate and certain epoxy resins used in commercial printing inks may be readily employed.

This invention provides a method and apparatus for forming a toned image. Initially, a latent electrostatic image is formed on an imaging device. A highly viscous or non-Newtonian liquid transfer layer is applied over the latent electrostatic image. The latent electrostatic image is then developed into the toned image.

BRIEF DESCRIPTION OF THE DRAWINGS

The invention will be described in detail with reference to the following drawings in which like reference numerals refer to like elements and wherein.

DETAILED DESCRIPTION OF PREFERRED EMBODIMENTS

Figure 1:
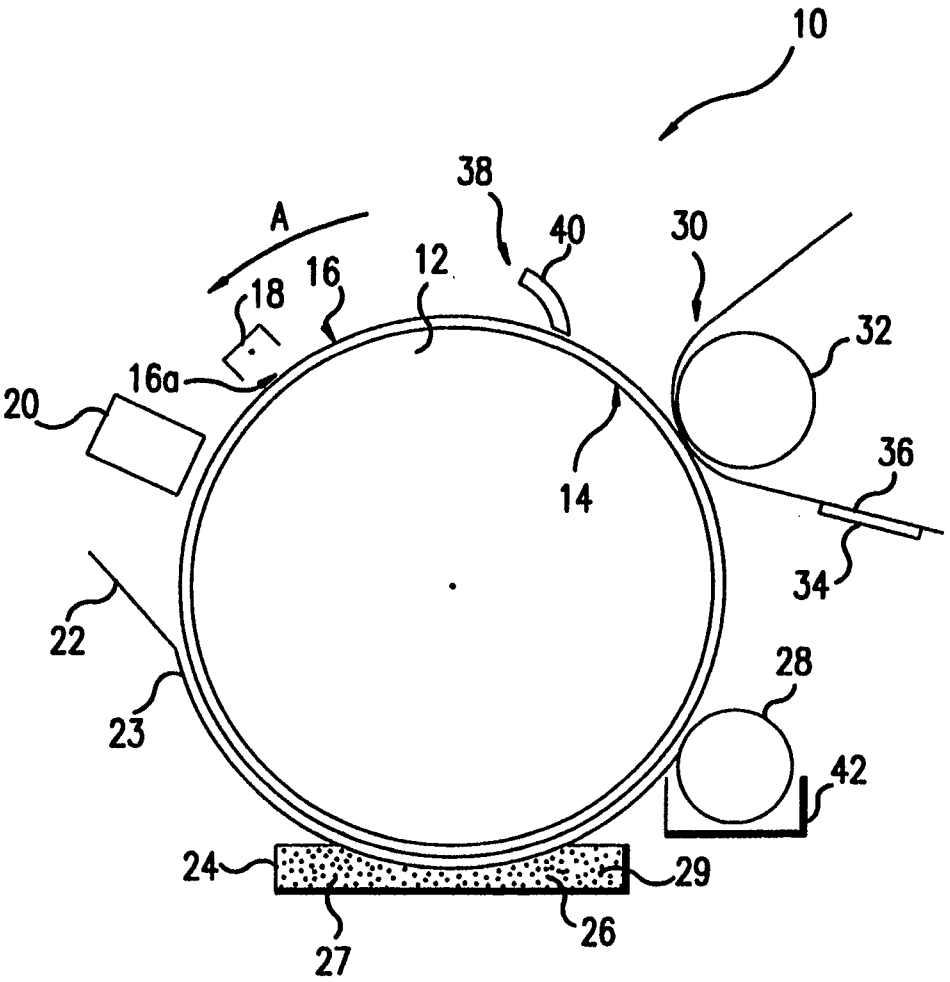
FIG. 1 is a schematic diagram of pertinent portions of a photoreceptive imaging drum system that may be used in accordance with the invention.

FIG. 1 shows an electrophotographic copying apparatus including an image forming device 10. However, the invention is not limited to use in electrophotographic copying systems, but may be used in any suitable liquid development printing system, including ionographic systems as well as printing, copying and other systems. Ionographic systems are described in U.S. Pat. Nos. 4,812,860, 4,538,163 and 5,176,974, the subject matter of which is incorporated herein by reference. In a preferred embodiment, the image forming device 10 is a drum 12 having an electrically grounded conductive substrate 14. A photoconctuctive layer 16 is provided on the electrically grounded substrate 14. Processing stations are positioned about the drum 12, such that as the drum 12 rotates in the direction of arrow A, the drum 12 transports a portion of the photoconductive surface **16*a* of the photoconductive layer 16 sequentially through each of the processing stations. The drum 12 is driven at a predetermined speed relative to the other machine operating mechanisms by a drive motor (not shown). Timing detectors (not shown) sense the rotation of the drum 12 and communicate with machine logic (not shown) to synchronize the various operations of the copying apparatus so that the proper sequence of operations is produced at each of the respective processing stations. In another embodiment, a belt may be used as an image forming device instead of the drum 12**, as is known in the art.

Initially, the drum 12 rotates the photoconductive layer 16 past a charging station 18. The charging station 18 may, for example, be a corona generating device as is known in the art. The charging station 18 sprays ions onto the photoconductive surface 16a to produce a relatively high, substantially uniform charge on the photoconductive layer 16. As is known in the art, the photoconductive layer 16 must be of a sufficient thickness and dielectric constant to have sufficient capacitance to develop the imagewise charge to a sufficient optical density.

Once the photoconductive layer 16 is charged, the drum 12 rotates to an exposure station 20 where a light image of an original document (not shown) is projected onto the charged photoconductive surface 16a. The exposure station 20 may include a laser ROS. Alternatively, the exposure station 20 may include a moving lens system. As is known in the art, the original document (not shown) is positioned upon a generally planar, substantially transparent platen (not shown). The scanned light image selectively dissipates the charge on the photoconductive surface 16a to form a latent electrostatic image corresponding to the image of the original document. While the preceding description relates to a light lens system, one skilled in the art will appreciate that other devices, such as a modulated laser beam, may be employed to selectively discharge the charged photoconductive surface 16a to form the latent electrostatic image, or a latent image may be formed by other means such as ion beams or the like.

After exposure, the drum 12 rotates the latent electrostatic image on the photoconductive surface 16a to a transfer layer applicator 22. The transfer layer applicator 22 applies a transfer layer 23 onto the photoconductive surface 16a.

In a preferred embodiment, the transfer layer 23 is a thin layer of a non-Newtonian liquid. This will typically comprise a gel in which the major component is a viscous liquid and the minor component is long strands of polymer molecules joined together at intersections to form a three-dimensional net. The transfer layer 23 typically has a viscosity greater than 5 centistokes or 10 centistokes, but the viscosity may be lower in embodiments. In a more preferred embodiment, the transfer layer 23 has a viscosity greater than 1000 centistokes such as greater than 5000 centistokes. The transfer layer applicator 22 applies a transfer layer 23 onto the photoconductive surface 16a using a doctor blade or other device. The transfer layer 23 must be thin enough and the openings in the polymer net must be coarse enough to allow pigment particles to move from the developer bath station 24 to the latent electrostatic image on the photoconductor. The density of polymer strands must be high enough (and accordingly the openings in the three-dimensional net must be small enough) that the gel has sufficient strength not to collapse as a result of the electrical field impressed across it. A highly viscous liquid is chosen as the major component of the transfer layer because it well withstands the tendency to be dissolved by the liquid carrier in the developer bath station 24 during the critical duration of the immersion in the developer bath station 24. If the liquid carrier has little tendency to dissolve the transfer layer, then the liquid transfer layer generally has a viscosity of 1 centistoke or greater. If the liquid carrier has a tendency to dissolve the transfer layer, then the liquid transfer layer would generally have a viscosity greater than 10 centistokes, depending on the process speed of the image forming device 10. Fluroinert FC-70 (manufactured by 3-M) is an example of a transfer layer that would not be dissolved by a mineral oil liquid carrier.

The transfer layer 23 may, for example, be 2–100 μm thick. It has been found that a transfer layer 23 having a thickness between 10 μm and 14 μm works very well. In a preferred embodiment, a 12 μm transfer layer 23 is applied onto the photoconductive surface 16a. It is found experimentally that the pigment particles 27 move through the transfer layer 23 carrying very little or none of the liquid developer carrier. Thus the transfer layer 23 acts as a virtually impermeable barrier to this liquid developer carrier while remaining open to the imagewise transport of pigment particles.

In a preferred embodiment, the transfer layer 23 is made from a commercially available high viscosity (30,000 centistoke to 200,000 centistoke) Dow Corning 200 oil (a dimethyl siloxane polymer) and a small quantity (1% to 25%) of commercially available Sylgard 186 elastomeric resin (described by the manufacturer as a resin similar to that of U.S. Pat. No. 3,284,406, assigned to Dow Corning, in which a major portion of the organic groups attached to silicon are methyl radicals). This produces a transfer layer 23 having a weak gel structure that has sufficiently open pores (net openings) to allow passage of the pigment particles 27, with adequate mechanical strength to hold up to the forces of the electrical field and good resistance to being dissolved by the liquid carrier. Other suitable gel materials can also be used as long as the pores of the transfer layer 23 are large enough to allow the pigment particles 27 to permeate through the transfer layer 23 but mechanically strong enough to withstand the force of the electrical field and sufficiently resistant to the tendency of the developer liquid carrier to dissolve the oil component of the transfer layer 23. Lower viscosity gel oils may also be used if they have inherently less tendency to dissolve in the developer carrier fluid. Because the transfer layer 23 has a virtually impermeable structure, problems of the prior art such as developer liquid carrier carryout and subsequent evaporation into the ambient are avoided because the liquid carrier 29 described below is unable to pass through the transfer layer 23 to the surface of the drum 12.

The present invention uses gels with sufficient mechanical strength to avoid problems caused by liquid interfaces under the influence of electric fields as described in J. M. Schneider and P. K. Watson, "Electrohydrodynamic Stability of Space-Charge-Limited Currents in Dielectric Liquids. Theoretical Study", The Physics of Fluids, Vol. 13, No. 8, 1948–1954, Aug. 1970 and M. J. Stephen and J. P. Straley, "Physics of Liquid Crystals", Rev. Mod. Phys., Vol 46, No. 4, pgs. 618–704, Oct. 1974. Experiments with the use of very high viscosity oils for the transfer layer, such as 100,000 centistoke silicone oil manufactured by Huls Chemical Co. (2731 Bartram Rd., Bristol, Pa.) (polydimethylsiloxane, trimethylsiloxane terminated), but without gel properties, were found to work over much narrower ranges of process conditions. Therefore, such very high viscosity oils are included within the scope of this invention.

Figure 2:
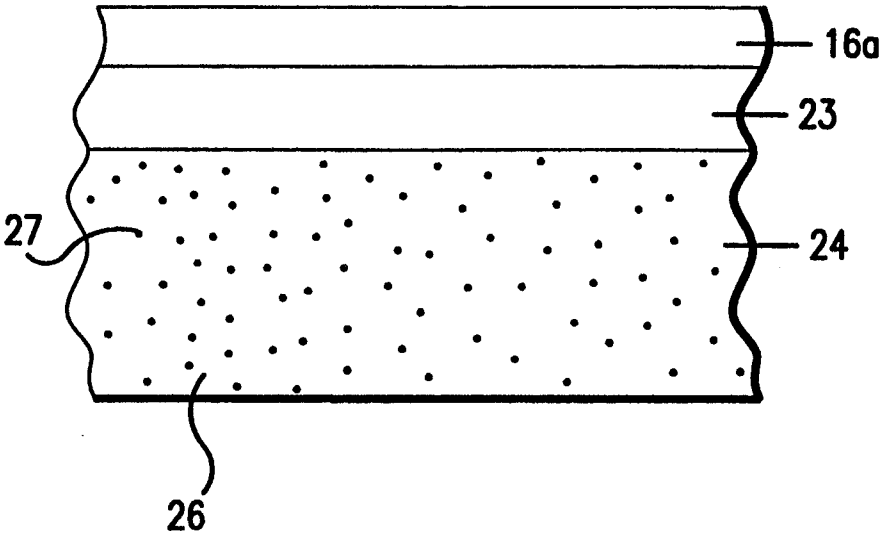
FIG. 2 is a side view of a developer bath station and transfer layer that may be used in accordance with the invention.

As the drum 12 continues rotating, the drum 12 rotates the transfer layer 23 and the latent electrostatic image formed on the photoconductor surface 16a to a developer bath station 24. In the developer bath station 24, liquid developer 26 is applied to the transfer layer 23 as shown in FIG. 2. The pigment particles 27 in the liquid developer 26 are attracted imagewise to the toner-transfer layer interface. The pigment particles 27 leave the liquid developer 26 and move under the influence of the electric field into and through the transfer layer 23 to the photoconductive surface 16*a*. Again, the motion of the pigment particles 27 in response to the imagewise electric field can generally be called electrophoresis. However, as described in relation to the present invention, this is a very special form of electrophoresis in which the pigment particles 27 move in first one liquid (the liquid carrier 29) and then in a second liquid (the transfer layer 23), having crossed a liquid interface boundary. It appears that little or none of the liquid carrier 29 accompanies the pigment particles 27 as they enter the transfer layer 23. This allows a separation of function of the two liquids, which is central to one aspect of the value of this invention.

In a preferred embodiment, the liquid developer 26 is comprised of pigment particles 27 such as carbon black or other black or colored pigment particles dispersed in a liquid carrier 29. For example, Cabot Mogul LGP-3049 Carbon Black manufactured by Cabot Corp., 125 High St., Boston, Mass. and Ferro F-6331 black pigment manufactured by Ferro Corp., 4150 East 56th St., Cleveland, Ohio are preferable as pigment particles 27.

This invention may accommodate a wide range of liquid developer 26 viscosities with good results. The liquid carrier 29 may have a high viscosity, which generally results in a lower volatility and generally lower solubility for the transfer layer oil. By using a low-volatility liquid carrier 29, problems of the prior art, such as airborne pollution, may be avoided more easily in a machine design. However, the speed of motion of charged pigment particles 27 through the liquid carrier 29 under the influence of an electrical field is roughly inversely proportional to the viscosity of the liquid. To compensate for this lower pigment particle mobility, the concentration of pigment particles 27 can be substantially increased, thereby requiring the pigment particles 27 to move shorter distances in reaching the transfer layer 23. The low volatility is accomplished preferably using a mineral oil, which would necessarily also have a high viscosity. The liquid carrier 29 may, for example, be a heavy mineral oil such as commercially available Blandol oil, (manufactured by Witco, Sonneborn Division) which is a clear, water white mineral oil with a viscosity of about 86 centistokes. For machines designed to operate at high rates it is preferable to use a lower viscosity liquid having a low solubility for the transfer layer oil and to use the liquid in an enclosure designed to retain the liquid vapors. Such a liquid is, for example, an isoparaffinic hydrocarbon such as Isopar (manufactured by Exxon Co., P.O. Box 2180, Houston, Tex.), which has a viscosity of about 2 centistokes. Again, much higher pigment loading can then be accommodated than would be practical with other liquid development systems. Accordingly, the liquid carrier generally has a viscosity of 0.5 centistokes up to several thousand centistokes.

It has also been found helpful to use a small quantity (1 to 3%) of a commercially available surface active agent, such as Aerosol OT-100 (manufactured by American Cyanamid Co., Process Chemicals Dept., One Cyanamid Plaza, Wayne, N.J.) or Basic Barium Petronate (manufactured by Witco, Sonneborn Div., 520 Madison Ave., N.Y., N.Y.). Surface active agents help in the dispersion of the pigment particles 27. Good dispersion is important, since if two or more pigment particles cling together, they have a much lower possibility of penetrating the pore structure of the transfer layer 23. In addition to the surface active agent, a charging agent is occasionally used. One such charging agent that has been tested with improved results (darker images) is 3-pyridylcarbinol (manufactured by Aldrich Chemical Co., 1001 West Saint Paul Ave., Milwaukee, Wis.). The use of this material for the improvement of properties of an etectrophoretic toner has been described in Larson et al, Journal of Imaging Science and Technology, Vol. 17, No. 5, Oct/Nov 1991, pg. 210.

A liquid developer of the invention may be prepared in the following proportions: 100 grams of Blandol mineral oil, 2 grams Cabot Mogul LPG 3049 Carbon Black, 100 milligrams Basic Barium Petronate and 80 milligrams 3-Pyridylcarbinol. The last ingredient may be omitted with satisfactory results. Many other formulations are also possible. For instance, Rust-Oleum Black paint (an oil-based black paint commercially available from K-Mart) has also been used with good success. If such a liquid developer 26 were used in prior art liquid development systems, the high viscosity coupled with the very large pigment concentration would have produced a background that would have obliterated the developed image. As it was, the background was very low.

A pigment particle weight concentration of, for example, between 0.01% to 10% of the oil weight produces quality prints. Most commercially available paints have a 5% to 10% pigment concentration by weight. Pigment particle weight concentrations up to 80% can be used in the present invention. Preferably, the pigment particle 27 weight concentration is 2% to 6% of the oil weight.

The present invention operates under a theory similar to gel permeation chromatography. Gel permeation chromatography is used to sort polymer molecules in a gel-packed column according to their size. It has been found that large pigment particles (0.5 $\mu$m and greater volume average particle diameter) are not able to move through a small-pore transfer layer 23 and therefore cannot be used effectively in the preferred embodiment. It is believed that this is because small particles move through pores in the transfer layer 23 while the large particles get enmeshed. Clearly, a transfer layer 23 made according to a different formulation would be able to pass larger particles such as about 0.5 $\mu$m and greater, or would be further restricted to smaller pigment particles, depending upon the average pore size resulting from the formulation. In general, polymers that exhibit stronger chains can be used in greater dilution in achieving the minimum gel stiffness required to sustain the mechanical effects of the electrical field. This would result in larger average pore sizes and therefore would permit the passage of larger pigment particles.

Small pigment particles have a larger charge-to-mass ratio than that of larger pigment particles. Therefore, in order to use small pigment particles, the charge associated with the imagewise voltage distribution must be larger than would be required for larger pigment particles in order to achieve a given optical density on the final print. It is desirable to use smaller pigment particles in order to obtain better resolution, lower image noise and greater grey scale latitude. Small pigment particles, as described in this specification, generally refers to pigment particles having a volume average particle diameter less than about 1 $\mu$m. Generally, small pigment particles have a volume average particle diameter larger than about 0.01 μm, although carbon black particles and other particles may be smaller. The increased charge associated with the voltage distribution of the image can be achieved by increasing the capacitance of the imaging member. In the case of a photoconductor, this could be done using a thinner photoconductor layer. In the case of ionography, this could also be done by using a thinner electroreceptor layer (i.e., commonly a plastic dielectric) and/or by increasing the dielectric constant of the electroreceptor. There is also the option in these cases, of course, to increase the imagewise voltage levels and use stiffer transfer layer formulations to compensate.

Following the developer bath station 24, a skimming roller 28 or other device mechanically removes residual developer from the surface of the drum 12. To ensure complete removal of the developer 26, a portion of the surface of the transfer layer 23 may be removed by the skimming roller 28. The residual developer is removed to prevent it from staining the image applied to the paper. The higher toner concentrations in the developer and the generally higher developer viscosities have the potential for causing highly objectionable staining of the image if left in place compared to the more conventional liquid development case where lower viscosity liquids are used and lower particle concentrations are used with consequently a very much lower potential for staining. The skimming roller 28 preferably does not remove all of the transfer layer 23 as that could result in pigment particles 27 being removed. Accordingly, the skimming roller 28 may remove, for example, approximately 25% to 75% of the transfer layer 23 from the surface of the drum 12. It has been found preferable to remove approximately 40% to 60% of the transfer layer 23. In a preferred embodiment having a 12 μm transfer layer 23, for example, the skimming roller 28 removes approximately 6 μm of the transfer layer 23. The thickness of the transfer layer 23 before and after the developer bath station 24 are provided merely for illustration purposes and are not intended to limit the scope of the invention. Following the removal of residual developer, pigment particles 27 continue to adhere to the photoconductive surface **16*a* to form a toned image on the surface of the drum 12. The residual developer that is removed by the skimming roller may be recycled in a recycle bin 42. The recycle bin 42 may be adapted to either recycle the residual developer into the developer bath station 24** or store the residual developer until being externally recycled or discarded.

The drum 12 continues rotating to a transfer station 30 having a conductive pressure roller 32, which may have a surface of conductive rubber or the like. A copy sheet 34 advances into the transfer station 30 along an intermediate belt 36. The pressure roller 32 applies physical pressure to the copy sheet 34 so that the copy sheet 34 is pressed against the remaining transfer layer on the drum surface 12. In a preferred embodiment, a force of 16 pounds/inch is applied to the pressure roller 32 although other values of force are within the scope of this invention. When the copy sheet 34 proceeds between the pressure roller 32 and the drum 12, a voltage potential is applied to the pressure roller 32 as is known in the art. The voltage potential applied to the pressure roller 32 enables the pigment particles 27 adhering to the electrostatic image to transfer to the copy sheet 34. The applied voltage may vary, but may, for example, be in the range of 400–1000 volts or more. In a preferred embodiment, a 600 volt potential is applied to the pressure roller 32 to transfer the pigment particles 27 from the drum 12 to the copy sheet 34. Other voltage potentials are similarly capable of use.

The combination of the physical pressure between the pressure roller 32 and the drum 12 and the applied electric field causes the pigment particles 27 to transfer from the drum surface to the copy sheet surface. The transfer layer 23 provides a medium for this to happen since it is forced into intimate contact with the copy sheet 34 and provides a liquid bridge for the electrophoretic transport of the pigment particles 27 in the electrical field. Augmenting this effect is the simple wicking of the transfer liquid into the fiber structure of the copy sheet, carrying the pigment particles 27 with it. The pigment particles 27 become enmeshed within the fibers of the copy sheet 34 to provide a permanent quality print, recreating a process that is familiar with printing inks. Thus, other means for causing adherence of the pigment are unnecessary. The copy sheet 34 continues rolling along the intermediate belt 36 until proceeding outside of the image forming device 10 to a copy sheet dispenser (not shown). Other transfer station embodiments are similarly available as is known in the art. Additionally, the transfer station may first transfer the toned image to an intermediate belt (not shown) or the like prior to transfer to the copy sheet 34.

Since less than all of the pigment particles 27 on the drum surface 12 are generally transferred to the copy sheet 34 in the transfer station 30, the drum 12 rotates to a cleaning station 38. In cleaning station 38, a scraping blade 40 or the like may be provided to remove both the transfer layer 23 and any pigment particles 27 still adhering to the drum 12. This cleans the drum surface so that subsequent print jobs may be performed. It has been found that in cases where the transfer of pigment particles 27 to the copy sheet is sufficiently complete, it is unnecessary to remove the residual transfer layer, since the uniform charge in the case of a photoconductor system and the imagewise charge in the case of an ionographic system are found to easily penetrate the transfer layer 23 and move to the solid interface.

While this invention has been described in conjunction with a specific apparatus and method, it is evident that many alternatives, modifications and variations will be apparent to those skilled in the art. This invention is intended to cover all alternatives, modifications and equivalents within the spirit and scope of the invention, as defined by the appended claims.

What is claimed is:

1. A method of developing an electrostatic latent image, comprising the steps of:

forming a latent electrostatic image on an imaging member;

applying a transfer layer over the latent electrostatic image formed on the imaging member, the transfer layer comprising a highly viscous liquid or a non-Newtonian liquid;

developing the latent electrostatic image into a toned image with a liquid developer, said liquid developer comprising pigment particles and a liquid carrier; and allowing said pigment particles to move through said transfer layer to at least a point below the transfer layer surface prior to transferring the toned image to an image receiving member.

2. The method of claim 1, wherein the non-Newtonian liquid is a gel.

3. The method of claim 1, wherein said viscous liquid has a viscosity greater than 10 centistokes.

4. The method of claim 1, wherein said viscous liquid has a viscosity greater than 5000 centistokes.

5. The method of claim 1, wherein said pigment particles move through said transfer layer to the imaging member surface.

6. The method of claim 1, wherein said liquid carrier has a viscosity of at least 5 centistokes.

7. The method of claim 1, wherein said liquid carrier has a viscosity less than 5 centistokes.

8. The method of claim 1, wherein said liquid carrier is a mineral oil.

9. The method of claim 1, wherein the liquid developer comprises carbon particles dispersed in mineral oil.

10. The method of claim 1, wherein said liquid carrier is an isoparaffinic hydrocarbon.

11. The method of claim 1, wherein the pigment particles comprise approximately 0.01% to 80% of the liquid developer by weight.

12. The method of claim 1, wherein the method further includes transferring the toned image from the imaging member to an image receiving member using a transferring device after forming the toned image.

13. The method of claim 12, wherein the transferring device applies a physical force between the image receiving member and the imaging member.

14. The method of claim 12, wherein the transferring device applies a voltage potential between the transferring device and the imaging member.

15. The method of claim 14, wherein the voltage potential is between 100 and 1000 volts.

16. The method of claim 12, wherein the developing step further includes removing a portion of said transfer layer from the imaging member after forming the toned image and before transferring the toned image.

17. The method of claim 16, wherein the removed portion of the transfer layer is approximately 25% to 75% of the thickness of the transfer layer.

18. The method of claim 1, wherein the electrostatic image is formed in a photoconductive layer on the imaging member.

19. The method of claim 1, wherein the electrostatic image is formed on a dielectric surface on an ionographic imaging member.

20. The method of claim 1, wherein the transfer layer has a thickness of approximately 2 to 100 μm.

21. A method of developing a latent electrostatic image on a surface of an image bearing member, comprising the steps of:

forming a latent electrostatic image on a surface of an image bearing member;

applying a transfer layer onto the latent electrostatic image formed on the surface of the image bearing member, the transfer layer comprising a gel that is capable of allowing pigment particles to move through said gel;

developing the latent electrostatic image into a toned image with a liquid developer, said liquid developer containing pigment particles and a liquid carrier; and allowing said pigment particles to move through said transfer layer to at least a point below the transfer layer surface prior to transferring the toned image to an image receiving member.

22. An apparatus for forming a toned image on an image receiving member comprising:

applying means for applying a transfer layer over a latent electrostatic image formed on a surface of an image member;

developing means for developing a latent image;

removing means for removing a portion of the transfer layer subsequent to developing the toned image and before transferring the toned image to an image receiving member; and transferring means for transferring the toned image to an image receiving member.

23. The apparatus of claim 22, wherein the applying means comprises a reservoir for transfer layer material.

24. The apparatus of claim 22, further comprising cleaning means for cleaning the surface of the image member subsequent transferring the toned image.

25. An imaging member for forming a toned image comprising:

an imaging layer for forming a latent electrostatic image; and a transfer layer applied over the imaging layer having means for allowing pigment particles from a liquid developer, that is to be contacted with said transfer layer, to permeate through said transfer layer to the imaging layer without allowing liquid carrier from said liquid developer to permeate through said transfer layer to said imaging layer.

26. The member of claim 25, wherein the transfer layer has a strength sufficient to withstand development fields.

27. The member of claim 25, wherein the transfer layer comprises a highly viscous liquid.

28. The member of claim 25, wherein the transfer layer comprises a non-Newtonian liquid.

* * * * *